US005664468A

United States Patent [19]

Murayama et al.

[11] Patent Number: 5,664,468

[45] Date of Patent: Sep. 9, 1997

[54] SCREW TIGHTENING MACHINE

[75] Inventors: Keijiro Murayama; Osamu Ebisawa, both of Tokyo, Japan

[73] Assignee: Max Co., Ltd., Tokyo, Japan

[21] Appl. No.: 616,270

[22] Filed: Mar. 15, 1996

[30] Foreign Application Priority Data

Mar. 15, 1995 [JP] Japan ..... 7-083186

[51] Int. Cl.[6] ..... B25B 23/04

[52] U.S. Cl. ..... 81/434; 81/57.37

[58] Field of Search ..... 81/57.37, 434, 81/435; 227/135, 136, 139, 107, 67

[56] References Cited

U.S. PATENT DOCUMENTS

| | | | |
|---|---|---|---|
| 2,943,652 | 7/1960 | Chilton | 81/435 |
| 3,558,031 | 1/1971 | Hillier | 227/136 |
| 3,615,049 | 10/1971 | Obergfell et al. | 227/136 |
| 3,907,014 | 9/1975 | Manino | 81/57.37 |
| 4,667,545 | 5/1987 | Gould, Jr. et al. | 81/57.37 |
| 4,778,094 | 10/1988 | Fishback | 227/139 |

FOREIGN PATENT DOCUMENTS

| | | | |
|---|---|---|---|
| 1430097 | 3/1976 | United Kingdom | 81/57.37 |

*Primary Examiner*—D. S. Meislin
*Assistant Examiner*—Joni B. Danganan
*Attorney, Agent, or Firm*—Jacobson, Price, Holman & Stern, PLLC

[57] ABSTRACT

A screw tightening machine is provided which comprises a main body 2 formed on an end of a grip 1, a nose 3 mounted on the forward part of the main body 2, and a magazine 5 for guiding and feeding a band in which evenly spaced screws **4*b* are fitted from the side of the grip 1 to the nose 3. The nose 3 moves relatively with respect to a direction in which a screw 4*b* is tightened. The screw 4*b* is driven out from the nose 3. An end of the magazine 5 is connected to the nose 3, and a part of the other end of the magazine 5 is slidably connected to the grip 1**.

1 Claim, 3 Drawing Sheets

SCREW TIGHTENING MACHINE

BACKGROUND OF THE INVENTION

1. Field of the Invention

This invention relates to a screw tightening machine in which a string of screws are fed from a magazine to a nose mounted on the forward part of the body of the machine and are driven out one by one from the nose.

2. Description of the Related Art

A magazine described in, for example, Japanese Patent Official Gazette No. Hei 1-60395 is known as an example for use in this type of screw tightening machine. This magazine is fixed to the body of a screw tightening machine and, inside of the magazine, a path along which a string of screws are guided is provided so that the screws are stably kept to smoothly carry out a screw tightening operation.

The screw tightening machine has a nose capable of, with respect to the body of the machine, moving in a direction in which a screw is tightened. In detail, the nose can protrude from or retract into the body of the machine. The screws kept in the magazine are fed to the nose. The nose to which the screws are fed moves relatively with respect to the body of the machine during the screw tightening operation, whereas the magazine from which the screws are fed is unmovably fixed to the body.

Accordingly, the screws 23 in the magazine 22 are pulled out of the magazine 22 when the nose 20 moves forwards as shown in FIG. 3, whereas the screws 23 are pulled into the magazine 22 when the nose 20 retracts as shown by the broken line in FIG. 3. In other words, whenever the screw tightening operating is carried out, the screws 23 move in the magazine 22 because of a pull and a push by the nose 20. This movement causes some difficulty in carrying out the screw tightening operation.

In addition, when the nose 20 stretches to its full length, a big gap is made between an outlet 24 of the magazine 23 and an inlet 25 of the nose 20. As a result, part of the screws arranged in a line stick out of the gap. Especially when the tightening operation is carried out in a state in which the nose 20 is directed downwards, the chained screws 23 fall out of the magazine 22 and hang down from the gap. This interferes with the operation.

SUMMARY OF THE INVENTION

It is therefore an object of the present invention to provide a screw tightening machine in which a string of screws (chained screws) do not move in a magazine regardless of the movement of a nose and in which the chained screws do not slap off from the magazine and not dangle from a gap.

The screw tightening machine according to the present invention comprises a main body formed on an end of a grip, a nose mounted on a forward part of the main body, and a magazine for guiding and feeding a band, in which evenly spaced screws are fitted, from a side of the grip to the nose. The nose is capable of moving relatively with respect to a direction in which a screw is tightened. The screw is driven out from the nose. In the screw tightening machine, an end of the magazine is connected to the nose so that the magazine can move in unison with the movement of the nose.

DETAILED DESCRIPTION OF THE EMBODIMENT

An embodiment of a screw tightening machine according to the present invention will be described hereinafter with reference to the attached drawings.

Figure 1:
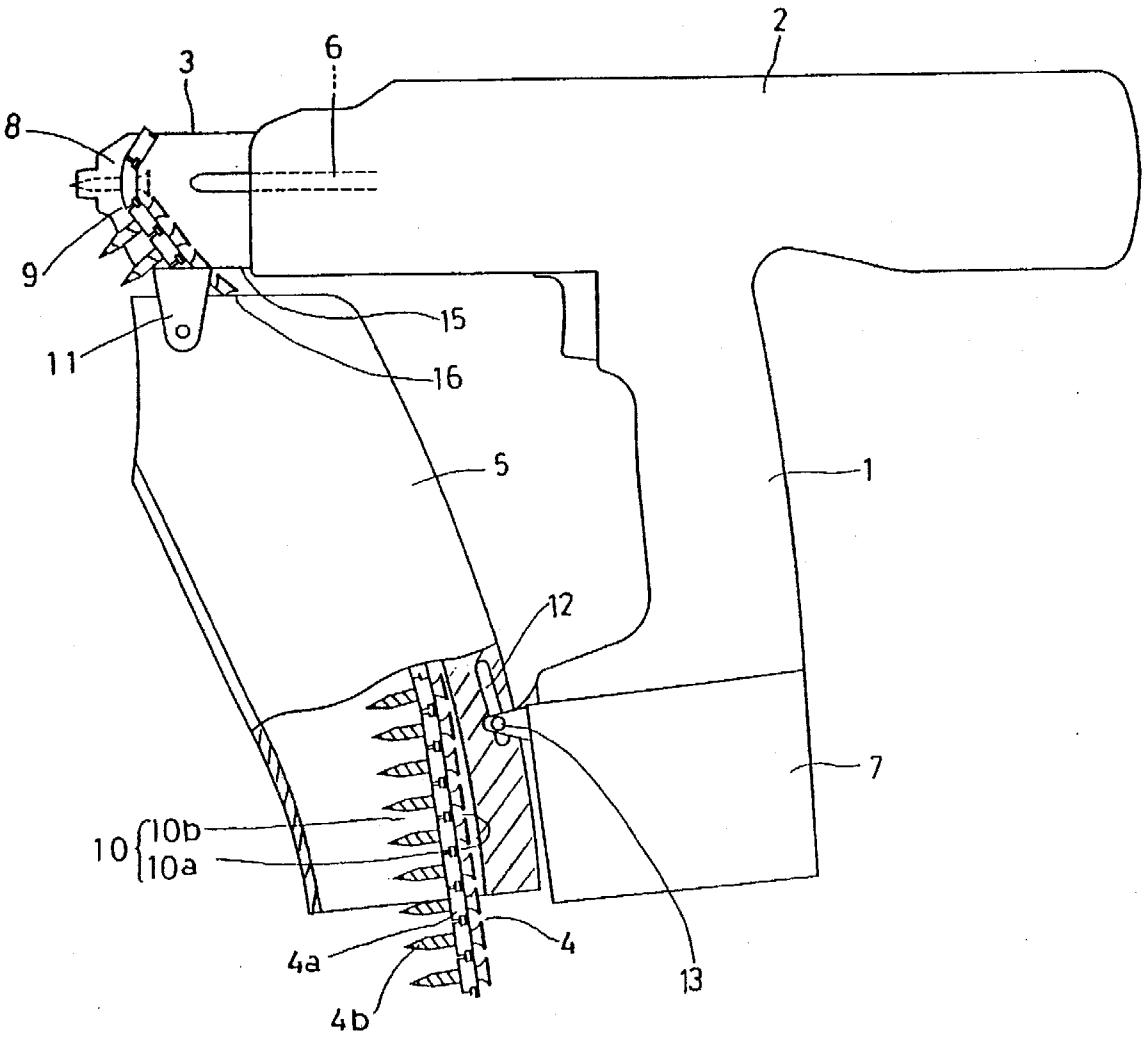
FIG. 1 is a view showing a screw tightening machine according to the present invention.

As shown in FIG. 1, the screw tightening machine comprises a main body 2 formed integrally with a grip 1, a nose 3 mounted on the forward part of the main body 2 so as to move relatively with respect to a direction in which a screw is tightened, and a magazine 5 from which a string of screws (chained screws) 4 are fed to the nose 3. An inlet 15 for the screws is formed in the lower surface of the nose 3, and an outlet 16 for the screws is formed in the upper surface of the magazine 5.

The screw set (chained screws) 4 comprises a band **4*a* and screws 4*b* evenly spaced in the band 4*a*. The screws 4*b* are removable from the band 4*a***.

The main body 2 has a driver bit 6 and a driving mechanism (not shown) for turning the driver bit 6. By the driver bit 6, one of the screws **4*b* which has been fed to the nose 3 is taken off from the band 4*a* and is turned to get it into, for example, a board. Reference numeral 7 designates a battery fixed to the lower part of the grip 1**.

The nose 3 is hollow and has a striking part 8 and a passageway 9 for the chained screws 4. The striking part 8 is formed on an extension line of an axis of the driver bit 6. The passageway 9 passes through the striking part a from the lower part to the upper part of the nose 3. In the nose 3, a feed mechanism (not shown) is provided for conveying the chained screws 4 along the passageway 9 upwards and feeding a screw **4*b* of the chained screws 4 to the striking part 8**.

The feed mechanism (not shown) is designed to feed a screw **4*b* to be subsequently driven out to the striking part 8 by conveying the chained screws 4 when the nose 3 moves relatively with the main body 2 of the machine. The force of a spring is always applied to the nose 3 in a direction in which the screw 4*b* is driven out with respect to the main body 2. As a result, the nose 3** is in a state of protrusion from the main body.

The magazine 5 is hollow and, in the hollow part, has a passageway 10 by which the chained screws 4 are kept drawn toward the side of the grip 1 and are guided to the nose 3. Following the passageway 10, the chained screws 4 are fed to the nose 3 through the outlet 16 and the inlet 15. The passageway 10 comprises a passage (not shown) for the band **4*a*, a passage 10*a* for a head of the screw 4*b*, and a passage 10*b* for a thread part of the screw The upper part of the magazine 5 is rotatably fixed to a link 11 mounted on the lower part of the nose 3. In a side face of the lower part of the magazine 5, a slit 12 is formed which elongates in up and down directions. A shaft 13 of the grip 1 is inserted into the slit 12 and is relatively slid along the slit 12**.

Figure 2:
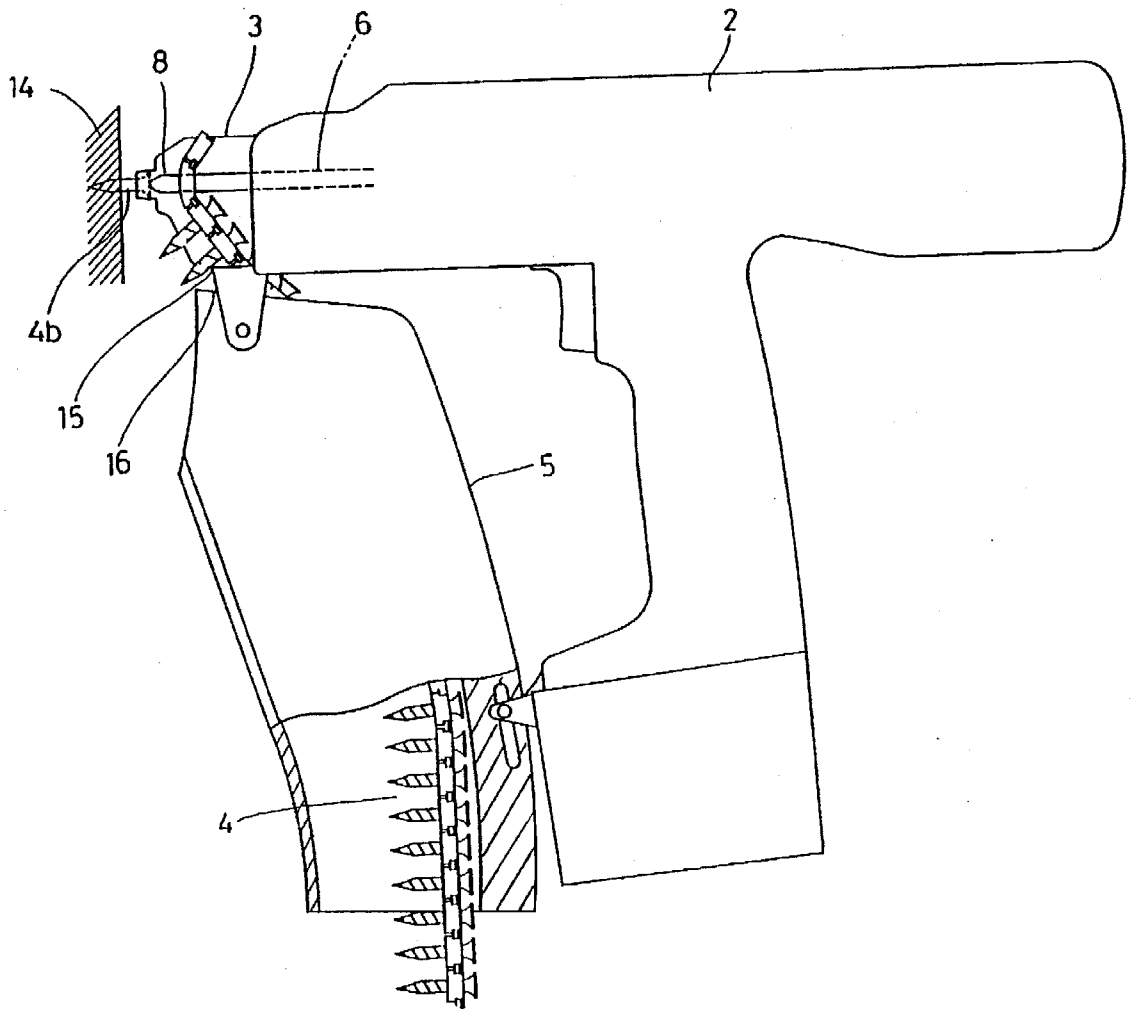
FIG. 2 is a descriptive drawing of the screw tightening machine in operation.
Figure 3:
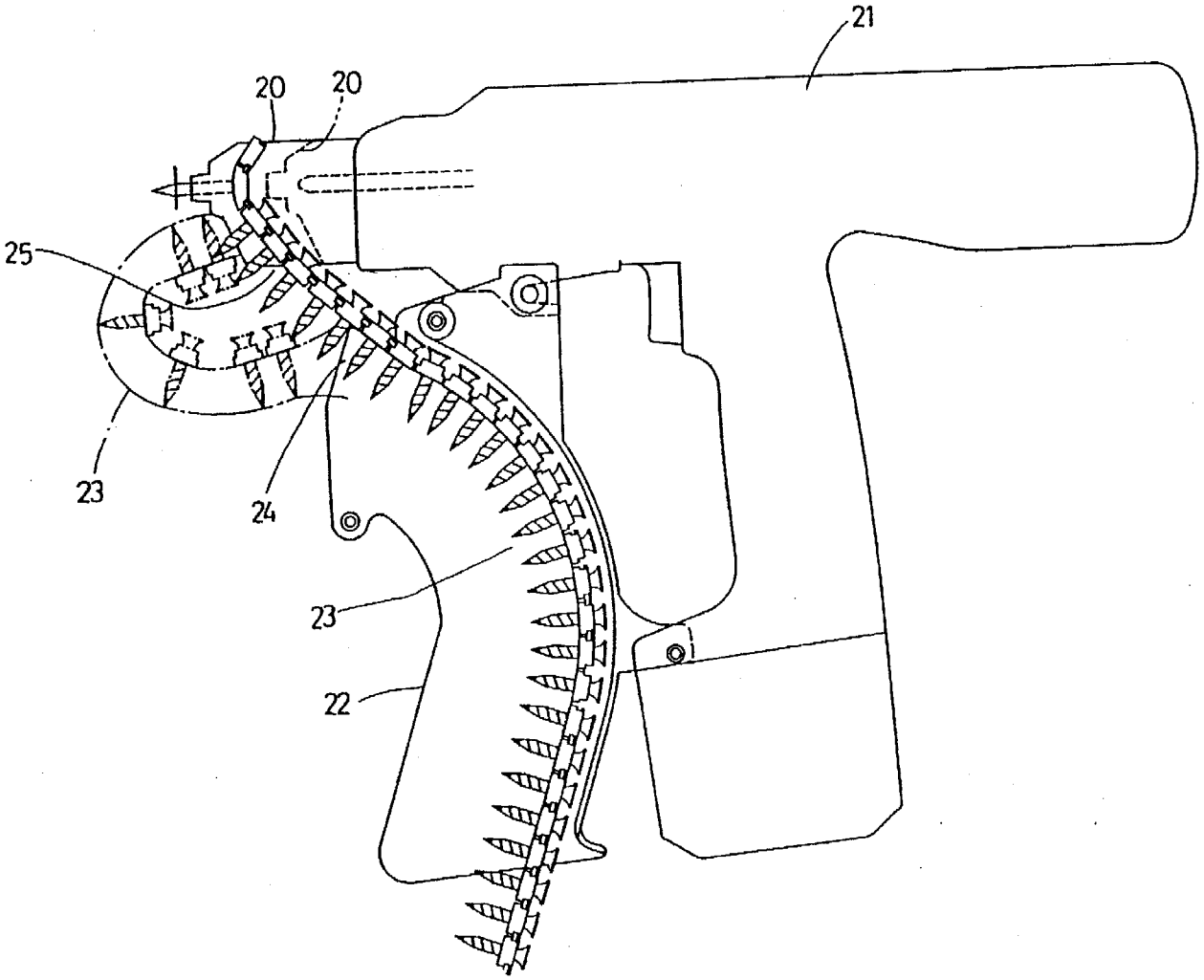
FIG. 3 (PRIOR ART)
FIG. 3 is a side view showing a conventional screw tightening machine.

According to the screw tightening machine thus constructed, as shown in FIG. 2, when the end of the nose 3 is pressed against a piece of material 14 into which a screw **4*b* is screwed and, in addition, the nose 3 is pushed to the main body 2 against the resilient force of the spring, the driver bit 6 relatively approaches the screw 4*b* situated in the striking part 8 of the nose 3. By pushing the nose 3 still more, the driver bit 6 is brought into contact with the screw 4*b* and is turned by the driving mechanism (not shown). With the driver bit 6 engaged with a groove of the head of the screw 4*b*, the screw 4*b* is turned. The screw 4*b* is taken off from the band 4*a* while turning. The screw 4*b* is then driven out from the end of the nose 3 and is screwed into the material 14**.

After that, when the nose 3 is separated from the material 14, the nose 3 again protrudes from the main body 2 of the machine by means of the resilient force of the spring and returns to its initial position shown in FIG. 1. When the nose 3 thus moves relatively with the main body 2, the chained screws 4 in the passageway 9 of the nose 3 are conveyed by the feed mechanism. Thereby, a screw **4*b* to be subsequently driven out is fed to the striking part 8 for the following tightening operation. According to the movement of the chained screws 4 in the passageway 9, the chained screws 4 in the magazine 5 are conveyed to the nose 3**.

As mentioned above, the nose 3 moves relatively with the main body 2 of the machine whenever the screw tightening operation is carried out. However, since the shaft 13 of the grip 1 is slidably inserted in the slit 12 formed in the lower part of the magazine 5, the upper part of the magazine 5 can move in unison with the movement of the nose 3. Therefore, there is not any fear that the chained screws 4 in the magazine 5 unnecessarily move according to the movement of the nose 3. Of course, the feed mechanism is actuated in response to the relative movement of the nose 3 so that screws **4*b* are fed to the striking part 8 one by one, but the quantity of movement of the chained screws 4 per screw 4*b*** is utterly negligible in the operation.

In addition, since the upper part of the magazine 5 moves in unison with the movement of the nose 3, a gap between the inlet 15 of the nose 3 and the outlet 16 of the magazine 5 can be always made constant without enlarging the gap, regardless of the movement of the nose 3. Accordingly, when the screw tightening operation is carried out in a state in which the nose 3 is directed downwards, the chained screws 4 do not slip off the magazine 5 and not dangle from the gap. Accordingly, the operation can be always carried out without any trouble.

What is claimed is:

1. A screw tightening machine comprising:

a main body formed in an the upper part of a grip, said grip extending upward and downward;

a nose mounted on a forward part of said main body, said nose being capable of moving forward and backward with respect to a direction in which a screw is tightened, the screw being driven out from said nose; and a magazine for guiding and feeding a band in which evenly spaced screws are fitted to said nose along a side of said grip;

wherein an upper end of said magazine is connected rotatably to said nose and a part of the lower end of said magazine is connected slidably upward and downward to said grip so that the upper end of said magazine moves with movement of said nose and the lower end of said magazine is slidable upward and downward along said grip.

* * * * *